US010747134B2

(12) United States Patent
Watanabe et al.

(10) Patent No.: US 10,747,134 B2
(45) Date of Patent: Aug. 18, 2020

(54) EXTERNAL TONER ADDITIVE, METHOD FOR PRODUCING EXTERNAL TONER ADDITIVE, AND TONER

(71) Applicant: CANON KABUSHIKI KAISHA, Tokyo (JP)

(72) Inventors: Shuntaro Watanabe, Hadano (JP); Tatsuya Saeki, Suntou-gun (JP); Atsuhiko Ohmori, Yokohama (JP); Shuhei Moribe, Mishima (JP); Hiroki Akiyama, Suntou-gun (JP); Kazumichi Nakahama, Suntou-gun (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/259,159

(22) Filed: Jan. 28, 2019

(65) Prior Publication Data

US 2019/0250528 A1 Aug. 15, 2019

(30) Foreign Application Priority Data

Feb. 14, 2018 (JP) ..... 2018-023934

(51) Int. Cl.
*G03G 9/08* (2006.01)
*G03G 9/087* (2006.01)
*G03G 9/097* (2006.01)

(52) U.S. Cl.
CPC ..... *G03G 9/0825* (2013.01); *G03G 9/0804* (2013.01); *G03G 9/0819* (2013.01); (Continued)

(58) Field of Classification Search
CPC ... G03G 9/0825; G03G 9/097; G03G 9/09708
(Continued)

(56) References Cited

U.S. PATENT DOCUMENTS 6,875,549 B2 4/2005 Yamazaki et al.
6,881,527 B2 4/2005 Moribe et al.
(Continued)

FOREIGN PATENT DOCUMENTS

JP 2004-212740 7/2004
JP 2013-083837 5/2013
(Continued)

OTHER PUBLICATIONS

U.S. Appl. No. 16/272,254, Shuntaro Watanabe, filed Feb. 11, 2019.

*Primary Examiner* — Mark A Chapman
(74) *Attorney, Agent, or Firm* — Venable LLP

(57) ABSTRACT

An external toner additive having a resin fine particle containing a crystalline resin and an inorganic fine particle embedded in the resin fine particle, wherein part of the inorganic fine particle is exposed on the surface of the resin fine particle, and in differential scanning calorimetry of the external toner additive, the maximum endothermic peak temperature T1 (° C.) during a first temperature increase and the maximum exothermic peak temperature T2 (° C.) during a first temperature decrease satisfy the formulae (1) to (3) below, with measurement performed between −40° C. and 150° C. at a rate of increase of 10° C./min during the first temperature increase and between 150° C. and −40° C. at a rate of decrease in temperature of 10° C./min during the first temperature decrease:

$$T1-T2 \leq 40.0 \quad (1)$$

$$50.0 \leq T1 \leq 120.0 \quad (2)$$

$$10.0 \leq T2 \leq 80.0 \quad (3).$$

19 Claims, 2 Drawing Sheets

(52) U.S. Cl.
CPC ..... *G03G 9/08755* (2013.01); *G03G 9/097* (2013.01); *G03G 9/09708* (2013.01)

(58) Field of Classification Search
USPC ..... 430/108.1
See application file for complete search history.

(56) References Cited

U.S. PATENT DOCUMENTS

| | | | |
|---|---|---|---|
| 7,014,969 | B2 | 3/2006 | Yachi et al. |
| 7,267,919 | B2 | 9/2007 | Moribe et al. |
| 7,273,686 | B2 | 9/2007 | Onuma et al. |
| 7,288,354 | B2 | 10/2007 | Moribe et al. |
| 7,351,509 | B2 | 4/2008 | Moribe et al. |
| 7,422,832 | B2 | 9/2008 | Ogawa et al. |
| 7,537,877 | B2 | 5/2009 | Yoshiba et al. |
| 7,544,455 | B2 | 6/2009 | Yoshiba et al. |
| 7,638,251 | B2 | 12/2009 | Yamazaki et al. |
| 7,700,254 | B2 | 4/2010 | Moribe et al. |
| 7,740,998 | B2 | 6/2010 | Yamazaki et al. |
| 7,855,042 | B2 | 12/2010 | Kobori et al. |
| 7,897,316 | B2 | 3/2011 | Yamazaki et al. |
| 8,026,030 | B2 | 9/2011 | Moribe et al. |
| 8,057,977 | B2 | 11/2011 | Moribe et al. |
| 8,501,377 | B2 | 8/2013 | Takahashi et al. |
| 8,512,925 | B2 | 8/2013 | Moribe et al. |
| 8,603,712 | B2 | 12/2013 | Aoki et al. |
| 8,614,044 | B2 | 12/2013 | Matsui et al. |
| 8,741,519 | B2 | 6/2014 | Watanabe et al. |
| 8,846,284 | B2 | 9/2014 | Kinumatsu et al. |
| 8,883,389 | B2 | 11/2014 | Matsui et al. |
| 9,040,216 | B2 | 5/2015 | Fukudome et al. |
| 9,097,998 | B2 | 8/2015 | Yamazaki et al. |
| 9,116,448 | B2 | 8/2015 | Terauchi et al. |
| 9,128,400 | B2 | 9/2015 | Takahashi et al. |
| 9,134,637 | B2 | 9/2015 | Hotta et al. |
| 9,141,012 | B2 | 9/2015 | Moribe et al. |
| 9,152,065 | B2 | 10/2015 | Sano et al. |
| 9,201,323 | B2 | 12/2015 | Nishikawa et al. |
| 9,213,250 | B2 | 12/2015 | Nomura et al. |
| 9,213,251 | B2 | 12/2015 | Ohmori et al. |
| 9,239,528 | B2 | 1/2016 | Hasegawa et al. |
| 9,250,548 | B2 | 2/2016 | Nomura et al. |
| 9,261,804 | B2 | 2/2016 | Yamazaki et al. |
| 9,261,806 | B2 | 2/2016 | Moribe et al. |
| 9,285,697 | B2 | 3/2016 | Fukudome et al. |
| 9,304,422 | B2 | 4/2016 | Matsui et al. |
| 9,309,349 | B2 | 4/2016 | Watanabe et al. |
| 9,341,970 | B2 | 5/2016 | Yoshiba et al. |
| 9,348,246 | B2 | 5/2016 | Magome et al. |
| 9,354,545 | B2 | 5/2016 | Matsui et al. |
| 9,429,860 | B2 | 8/2016 | Kinumatsu et al. |
| 9,442,416 | B2 | 9/2016 | Magome et al. |
| 9,470,993 | B2 | 10/2016 | Nishikawa et al. |
| 9,575,425 | B2 | 2/2017 | Naka et al. |
| 9,588,450 | B2 | 3/2017 | Tsuda et al. |
| 9,606,462 | B2 | 3/2017 | Nomura et al. |
| 9,625,844 | B2 | 4/2017 | Kaya et al. |
| 9,658,554 | B2 | 5/2017 | Kinumatsu et al. |
| 9,715,188 | B2 | 7/2017 | Terauchi et al. |
| 9,772,570 | B2 | 9/2017 | Tsuda et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,829,818 | B2 | 11/2017 | Yoshiba et al. |
| 9,857,713 | B2 | 1/2018 | Kosaki et al. |
| 9,869,943 | B2 | 1/2018 | Aoki et al. |
| 9,964,874 | B2 | 5/2018 | Suzumura et al. |
| 9,971,263 | B2 | 5/2018 | Fukudome et al. |
| 10,101,683 | B2 | 10/2018 | Nishikawa et al. |
| 10,162,280 | B2 | 12/2018 | Nishikawa et al. |
| 2004/0110076 | A1 | 6/2004 | Yamazaki et al. |
| 2010/0035171 | A1 | 2/2010 | Watanabe et al. |
| 2013/0252167 | A1 | 9/2013 | Moribe et al. |
| 2013/0309603 | A1 | 11/2013 | Takahashi et al. |
| 2015/0125790 | A1 | 5/2015 | Hotta et al. |
| 2015/0185658 | A1 | 7/2015 | Wakabayashi et al. |
| 2016/0139522 | A1 | 5/2016 | Yoshiba et al. |
| 2016/0161874 | A1 | 6/2016 | Yamazaki et al. |
| 2018/0173125 | A1 | 6/2018 | Fukudome et al. |
| 2018/0173126 | A1 | 6/2018 | Ohmori et al. |
| 2018/0231901 | A1 | 8/2018 | Koji et al. |
| 2018/0329323 | A1 | 11/2018 | Kimura et al. |

FOREIGN PATENT DOCUMENTS

| | | |
|---|---|---|
| JP | 2015-045859 | 3/2015 |
| JP | 2016-133578 | 7/2016 |

EXTERNAL TONER ADDITIVE, METHOD FOR PRODUCING EXTERNAL TONER ADDITIVE, AND TONER

BACKGROUND OF THE INVENTION

Field of the Invention

The present invention relates to an external toner additive for use in image-forming methods including electrophotographic methods, to a method for producing this external toner additive, and to a toner using this external toner additive.

Description of the Related Art

As image-forming apparatuses such as copiers and printers using electrophotographic technology have come to be used for more diverse purposes and in more diverse environments, there has been increasing demand for higher speeds and higher image quality. Because the time taken to pass through the fixing unit is shorter the faster the printer speed, the amount of heat received by the toner is reduced even if the set temperature of the fixing unit is the same. Furthermore, lower fixing temperatures are also desirable from the standpoint of energy savings, and there is demand for toners with good low-temperature fixability.

Sharp melting of the toner in the fixing nip is desirable for improving low-temperature fixability, and designs that soften the surface layer of the toner particle and the like are in demand for this purpose. In particular, in high-speed printers in which less heat is received by the toner in the fixing nip, it is important to melt the surface layers of the toner particles in the fixing nip to thereby fuse the toner particles together.

Japanese Patent Application Publication No. 2004-212740 discloses a technology for increasing the low-temperature fixability and heat-resistant storage stability by externally adding an inorganic fine particle and a crystalline resin fine particle to the toner particle. Japanese Patent Application Publication No. 2013-83837 discloses a technology for improving developing performance and transferability by adding an external additive comprising an inorganic fine particle mechanically embedded in the surface of a crystalline resin fine particle.

However, although low-temperature fixability is improved by these methods, the crystalline resin fine particles serve as charge leak sites, and have tended to cause uneven charge distribution and lower developing performance.

Japanese Patent Application Publication No. 2016-133578 discloses a technique for improving developing performance by adding to the toner an external additive consisting of a composite particle comprising an inorganic fine particle embedded in the surface of a resin fine particle. However, although this method has improved developing performance, it has not succeeded in improving low-temperature fixability at high speeds.

In this context, Japanese Patent Application Publication No. 2015-45859 discloses a technique for improving low-temperature fixability and developing performance in high-temperature, high-humidity environments by externally adding to the toner particle a composite fine particle comprising an inorganic fine particle embedded in a resin fine particle with a melting point ranging from 60° C. to 150° C.

SUMMARY OF THE INVENTION

However, although low-temperature fixability is improved with the external additive described in Japanese Patent Application Publication No. 2015-45859 due to the lower recrystallinity of the crystalline resin, the toner does not cohere easily on the paper during paper discharge from higher-speed printers. As a result, a problem has been identified of toner adhering to the reverse surface of the paper (back soiling) when multiple output images are stacked atop one another.

Thus, there is still room for improvement in order to improve low-temperature fixability by melting surface layer of the toner particle, and reduce back soiling.

The inventors' researches have shown that the toners described in the above patent documents show room for improvement in terms of reducing back soiling while maintaining low-temperature fixability in the context of higher speeds, longer life spans, energy savings and miniaturization.

It is therefore an object of the present invention to provide an external toner additive that contributes to reducing back soiling while improving low-temperature fixability and heat-resistant storage stability even as the speed of image-forming apparatuses increases, as well as a method for producing the external toner additive and a toner having the external toner additive.

The present invention is an external toner additive comprising a resin fine particle containing a crystalline resin, and an inorganic fine particle embedded in the resin fine particle, wherein part of the inorganic fine particle is exposed on the surface of the resin fine particle, and in differential scanning calorimetry of the external toner additive, the maximum endothermic peak temperature T1 (° C.) during the first temperature increase and the maximum exothermic peak temperature T2 (° C.) during the first temperature decrease satisfy the following formulae (1) to (3) below, with measurement performed from −40° C. to 150° C. at a rate of increase of 10° C./min during the first temperature increase and from 150° C. to −40° C. at a rate of decrease in temperature of 10° C./min during the first temperature decrease:

$$T1-T2\leq 40.0 \quad (1)$$

$$50.0\leq T1\leq 120.0 \quad (2)$$

$$10.0\leq T2\leq 80.0 \quad (3).$$

Moreover, the present invention is also a method for producing an external toner additive having a resin fine particle containing a crystalline resin and an inorganic fine particle embedded in the resin fine particle, in which part of the inorganic fine particle is exposed on the surface of the resin fine particle, comprising a step (i) of preparing a liquid dispersion A comprising the inorganic fine particle dispersed in a solution in which the crystalline resin is dissolved in an organic solvent, a step (ii) of preparing a liquid dispersion B by adding a neutralizing agent with an acid dissociation constant pKa of at least 7.0 to the liquid dispersion A, and a step (iii) of adding water to the liquid dispersion B to prepare a liquid dispersion C comprising the external toner additive dispersed by phase inversion emulsification, wherein in differential scanning calorimetry of the external toner additive, the maximum endothermic peak temperature T1 (° C.) during the first temperature increase satisfies the following formula (2) below:

$$50\leq T1\leq 120.0 \quad (2).$$

The present invention also relates to a toner comprising a toner particle containing a binder resin and a colorant, and an external toner additive on the surface of the toner particle, wherein the external toner additive comprises the external toner additive described above.

With the present invention, it is possible to obtain an external toner additive that contributes to reducing back soiling while improving low-temperature fixability and heat-resistant storage stability even as the speed of image-forming apparatuses increases, as well as a method for producing the external toner additive and a toner having the external toner additive.

Further features of the present invention will become apparent from the following description of exemplary embodiments with reference to the attached drawings.

DESCRIPTION OF THE EMBODIMENTS

Figure 1:
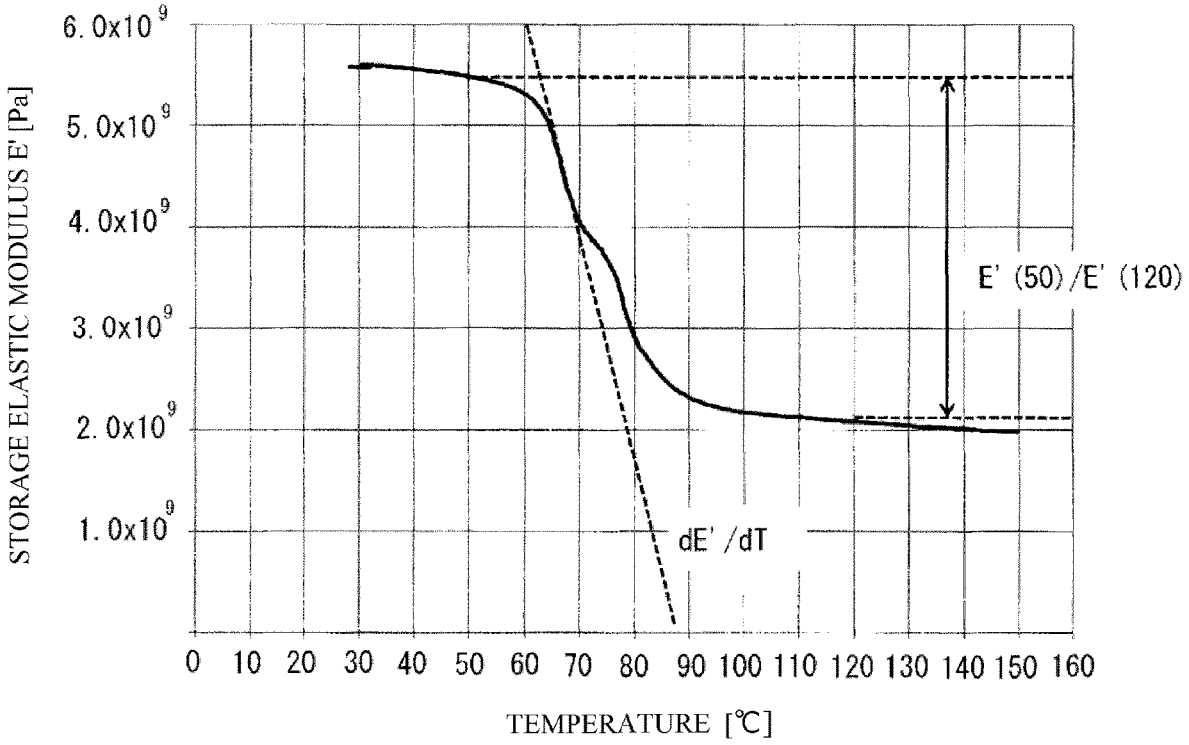
FIG. 1 is a temperature T-storage modulus E' curve obtained by powder dynamic viscoelasticity measurement.

Unless otherwise specified, descriptions of numerical ranges such as "from A to B" or "A to B" in the present invention include the numbers at the upper and lower limits of the range.

In the present invention, the combination of the upper and lower limits of a range may be determined from all combinations of upper and lower limits given in the Description.

The external toner additive of the invention has a resin fine particle containing a crystalline resin and an inorganic fine particle embedded in the resin fine particle. That is, the external toner additive of the invention is characterized by having part of the inorganic fine particle exposed on the surface of the resin fine particle, forming bumps derived from the inorganic fine particle.

The purpose of using a resin fine particle containing a crystalline resin is to improve the lower-temperature fixability of the toner by melting the crystalline fine resin at the time of fixing and promoting surface layer adhesion (adhesion of the region near the surface) between toner particles.

Consequently, in the external toner additive of the invention the maximum endothermic peak temperature T1 (° C.) during the first temperature increase in differential scanning calorimetry (DSC) satisfies the following formula (2):

$$50.0 \leq T1 \leq 120.0 \quad (2).$$

If T1 is above 120.0° C., the effect of improving the low-temperature fixability of the toner is small. If the T1 is below 50° C., heat-resistant storage stability may be insufficient. The maximum endothermic peak temperature T1 is preferably at least 60° C., and the upper limit is preferably not more than 110° C. The T1 can be controlled by controlling the composition of the crystalline resin.

The purpose of embedding the inorganic fine particle in the surface of the resin fine particle with part exposed to form bumps derived from the inorganic fine particle is to increase the contact area between the external toner additive and both the toner particle and the paper, thereby increasing the adhesive force between the unfixed toner and the paper, and controlling detachment of the toner from the paper.

The external toner additive of the invention needs to recrystallize rapidly after the toner particles have melted and their surface layers have adhered together in the fixing step. It is thought that recrystallization is easier the higher the recrystallization temperature. The recrystallization temperature is the maximum exothermic peak temperature in the first temperature decrease following the first temperature rise in differential scanning calorimetry.

Consequently, in the external toner additive of the invention the maximum exothermic peak temperature T2 (° C.) in the first temperature decrease satisfies the following formula (3) in differential scanning calorimetry:

$$10.0 \leq T2 \leq 80.0 \quad (3).$$

If the maximum exothermic peak temperature T2 is less than 10.0° C., recrystallization of the external toner additive does not progress well, detracting from the effect of surface layer adhesion between toner particles, and making toner detachment more likely. As a result, detached toner adheres to the back of the paper when printed papers are stacked, causing back soiling. More preferably, the maximum exothermic peak temperature T2 of the first temperature decrease is at least 20.0° C.

The upper limit is preferably not more than 40.0° C. The T2 can be controlled by controlling the composition of the crystalline resin, the type and amount of the neutralizing agent, and the amount of the surfactant added.

Moreover, in differential scanning calorimetry of the external toner additive the maximum endothermic peak temperature T1 (° C.) during the first temperature increase and the maximum exothermic peak temperature T2 (° C.) during the first temperature decrease must satisfy the following formula (1):

$$T1 - T2 \leq 40.0 \quad (1).$$

If T1-T2 is above 40° C., it becomes difficult to achieve both low-temperature fixability and recrystallization of the toner. Measurement is performed between −40° C. and 150° C. at a rate of increase of 10° C./min during the first temperature increase and between 150° C. and −40° C. at a rate of decrease in temperature of 10° C./min during the first temperature decrease.

T1-T2 is preferably not more than 38° C., or more preferably not more than 36° C. There is no particular lower limit, but preferably it is at least 5° C., or more preferably at least 10° C.

The number-average particle diameter of a primary particle of the external toner additive according to the dynamic light scattering method is preferably from 50 nm to 300 nm. More preferably it is at least 50 nm, and the upper limit is preferably not more than 250 nm. This is because controlling the particle diameter of the external toner additive within a fixed range makes it easier to melt the surface layer of the external toner additive on the toner particle surface and fix the toner uniformly on the paper when the toner is melted in the fixing nip. If the particle diameter is not more than 300 nm, surface layer adhesion by the external toner additive proceeds more easily and good image density can be obtained because there is good heat conduction to the center of the external toner additive during fixing.

The inorganic fine particle used in the external toner additive is preferably at least one selected from the group consisting of a silica fine particle, an alumina fine particle, a titania fine particle, a zinc oxide fine particle, a strontium titanate fine particle, a calcium carbonate fine particle and a cerium oxide fine particle.

In particular, an external toner additive using a silica fine particle as an inorganic fine particle is desirable because it imparts superior charging performance to the toner when combined with the toner particle. The silica fine particle may be fumed silica or the like obtained by a dry process, or may be obtained by a wet process such as a sol-gel process.

The crystalline resin contained in the resin fine particle used in the external toner additive is explained here. The crystalline resin is a resin having a clear melting point in differential scanning calorimetry.

The crystalline resin is not particularly limited, and examples include crystalline polyester resins, crystalline polyurethane resins, crystalline acrylic resins, ethylene-vinyl acetate copolymers, and vinyl resins grafted with modified waxes and the like.

As discussed above, if the maximum endothermic peak temperature T1 of the external toner additive during the first temperature increase in differential scanning calorimetry is from 50.0° C. to 120.0° C., the toner particle surface layer can be plasticized and surface layer adhesion between toner particles promoted. Because polyester is polar, it increases adhesiveness between the external additive and the paper, thereby improving low-temperature fixability. Consequently, the crystalline resin preferably contains a crystalline polyester, and more preferably is a crystalline polyester.

The method for manufacturing the crystalline polyester is not particularly limited, and a conventional known manufacturing method may be used as long as it does not detract from the effects of the invention. For example, the crystalline polyester may be manufactured by condensation polymerization of a polyhydric alcohol and a polyvalent carboxylic acid.

Examples of the polyhydric alcohol include, but are not limited to, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. These may be used individually, or a mixture thereof may be used.

Examples of the polyvalent carboxylic acid include, but are not limited to, oxalic acid, malonic acid, succinic acid, glutaric acid, adipic acid, pimelic acid, suberic acid azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, as well as lower alkyl esters and acid anhydrides of these. These may be used individually, or a mixture thereof may be used.

The method for manufacturing the crystalline polyester is not particularly limited, and it can be manufactured by an ordinary polyester polymerization method in which the acid component is reacted with the alcohol component. For example, direct polycondensation and ester-exchange methods can be used separately as appropriate according to the types of monomers.

The crystalline resin contained in the resin fine particle used in the external toner additive preferably has an acid value compatible with the resin fine particle manufacturing method explained below. The acid value of the crystalline resin is preferably from 5.0 mg KOH/g to 30.0 mg KOH/g, or more preferably at least 6.0 mg KOH/g, with an upper limit of not more than 27.0 mg KOH/g.

If the acid value is at least 5.0 mg KOH/g, the resin fine particle is easier to manufacture by phase inversion emulsification. If it is not more than 30.0 mg KOH/g, on the other hand, it is easy to increase the degree of crystallization of the crystalline resin, resulting in good heat-resistant storage stability of the external toner additive.

The number-average molecular weight of the crystalline resin contained in the resin fine particle is preferably from 3,000 to 60,000. If it is at least 3,000, it is easy to increase the degree of crystallization of the crystalline resin, resulting in good heat-resistant storage stability of the external toner additive. If it is not more than 60,000, on the other hand, the ability to plasticize the surface layer of the toner particle is greater, increasing the effect of improving the low-temperature fixability of the toner. More preferably, the number-average molecular weight is from 5,000 to 50,000.

The method for manufacturing the external toner additive is explained next. The method for manufacturing the external toner additive is a method for manufacturing an external toner additive comprising a resin fine particle containing a crystalline resin and an inorganic fine particle embedded in the resin fine particle, in which part of the inorganic fine particle is exposed on the surface of the resin fine particle, comprising a step (i) of preparing a liquid dispersion A comprising the inorganic fine particle dispersed in a solution in which the crystalline resin is dissolved in an organic solvent, a step (ii) of preparing a liquid dispersion B by adding a neutralizing agent with an acid dissociation constant pKa of at least 7.0 to the liquid dispersion A, and a step (iii) of adding water to the liquid dispersion B to prepare a liquid dispersion C comprising the external toner additive dispersed by phase inversion emulsification, wherein in differential scanning calorimetry of the external toner additive, the maximum endothermic peak temperature T1 (° C.) during the first temperature increase satisfies the following formula (2) below:

$$50 \leq T1 \leq 120.0 \quad (2).$$

A resin other than the crystalline resin may also be co-dissolved in the liquid dispersion A above.

With steps (i) to (iii) above, because the surface of the inorganic fine particle is hydrophilic, the inorganic fine particle is exposed to a suitable degree at the boundary between the resin fine particle and the water when the resin fine particle is formed by phase inversion emulsification of the crystalline resin, resulting in an external toner additive comprising the inorganic fine particle embedded and partially exposed on the surface of the resin fine particle.

The purpose of adding a neutralizing agent with a pKa of at least 7.0 in the step (ii) is to neutralize the acidic functional groups of the crystalline resin or the acidic functional groups of a resin other than the crystalline resin that has been co-dissolved with the crystalline resin. This promotes dissociation of the acidic functional groups in the step (iii), so that the dispersion stability of the external toner additive contained in the liquid dispersion C can be ensured by electrostatic repulsive force.

To impart good dispersion stability to the resin fine particle, the pKa of the neutralizing agent is preferably from 7.5 to 14.0, or more preferably from 9.0 to 13.0, or still more preferably from 9.0 to 12.0. Within this range, it is easy to obtain an external toner additive with a sharp particle size distribution. Moreover, if the pKa is within this range the temperature T2 tends to be lower, making it easier to reduce back soiling because the crystalline resin recrystallizes more easily.

Examples of the neutralizing agent include, but are not limited to, those given below. The temperatures in brackets are boiling points.

Examples include ammonia water (−33° C.), amines such as N-methyl-ethanolamine (155° C.), N,N-dimethylethanolamine (133° C.), 2-diethylaminoethanol (161° C.), triethylamine (90° C.), ethanolamine (170° C.), triethanolamine (208° C.), N-methyl-diethanolamine (246° C.), tri-n-butylamine (216° C.), bis-3-hydroxypropylamine (185° C.), 2-amino-2-methyl-1-propanol (165° C.), 1-amino-2-propanol (160° C.), 2-amino-2-methyl-1-3-propanediol (151° C.), cyclohexylamine (135° C.), t-butylamine (78° C.), N-methylmorpholine (115° C.) and hydroxylamine (58° C.), salts of weak acids and strong bases, such as sodium carbonate and potassium carbonate, and alkali metal hydroxides such as sodium hydroxide and potassium hydroxide. These may be used individually, or a mixture thereof may be used.

The boiling point of the neutralizing agent is preferably not more than 140° C., or more preferably from 0° C. to 130° C.

If the boiling point is not more than 140° C., it is easier to remove excess neutralizing agent not used to neutralize the acidic functional groups. The neutralizing agent is thus less likely to become a residue, and the crystalline resin is less likely to be plasticized, resulting in good heat-resistant storage stability. A volatile neutralizing agent is unlikely to form a residue, and for example ammonia, triethylamine, dimethanolamine or the like is preferred.

The amount of the neutralizing agent added is preferably from 0.5 to 15.0 mass parts, or more preferably from 1.0 to 12.0 mass parts, or still more preferably from 3.0 to 10.0 mass parts per 100.0 mass parts of the crystalline resin. Manufacture by phase inversion emulsification is easier if the amount of the neutralizing agent added is at least 0.5 mass parts. If the amount of the neutralizing agent added is not more than 15.0 mass parts, the aforementioned maximum exothermic peak temperature T2 (also called the recrystallization temperature) tends to be higher, and it is easier to suppress back soiling.

In the method for manufacturing the external toner additive, a surfactant may be contained in the water in the step (iii). The surfactant may be a low-molecular-weight surfactants with a weight-average molecular weight of 1,000 or less. If the weight-average molecular weight is 1,000 or less, the surfactant can later be removed efficiently from the resulting resin fine particle. Examples of surfactants include known anionic surfactants, cationic surfactants and non-ionic surfactants.

Specific examples of anionic surfactants include dodecylbenzene sulfonate, decylbenzene sulfonate, undecylbenzene sulfonate, tridecylbenzene sulfonate, nonylbenzene sulfonate and sodium, potassium and ammonium salts of these, and sodium dodecyl sulfonate and the like.

Specific examples of cationic surfactants include cetyl trimethyl ammonium bromide, hexadecyl pyridinium chloride and hexadecyl trimethyl ammonium chloride.

Specific examples of non-ionic surfactants include oxyethylene alkyl ethers and the like. Two or more kinds of surfactants may also be used together.

When using a surfactant, the amount of the surfactant added is preferably not more than 1.0 mass part, or more preferably not more than 0.5 mass parts, or still more preferably not more than 0.2 mass parts per 100.0 mass parts of the crystalline resin. If the amount of the surfactant added is not more than 1.0 mass part, the surfactant can be easily removed from the external additive by ultrafiltration or the like. As a result, back soiling is suppressed because the crystalline resin is less likely to plasticize and the recrystallization temperature is likely to be higher.

In the method for manufacturing the external toner additive, it is desirable to use an organic solvent that not only is capable of dissolving the crystalline resin, but also either undergoes liquid/liquid separation or is optionally miscible with water-based dispersion media. Examples of such organic solvents include, but are not limited, to cyclohexane, toluene, chloroform, ethyl acetate and tetrahydrofuran. These may be used individually, or a mixture thereof may be used.

A disperser may also be used in any or all of steps (i) to (ii) above. For example, a disperser such as a homogenizer, ball mill, colloid mill or ultrasound disperser may be used. The liquid dispersion of the manufactured external toner additive is also preferably subjected to a purification step before being stored. The purification step is not particularly limited, and for example a conventional method such as centrifugation, dialysis or ultrafiltration may be used.

When manufacturing the external toner additive, the hydrophobicity of the inorganic fine particle is preferably not more than 30 methanol vol %, or more preferably not more than 25 methanol vol %. There is no particular lower limit, but preferably it is at least 3 methanol vol %, or more preferably at least 5 methanol vol %.

The hydrophobicity here is a value determined by wettability testing of the inorganic fine particle with methanol. If the hydrophobicity is not more than 30 methanol vol %, because the inorganic fine particle is suitably hydrophilic it is less likely to be released on the water side during phase inversion emulsification and more likely to form bumps in the step (iii).

In the method for manufacturing the external toner additive, the amount of the inorganic fine particle added in the step (i) is preferably from 20 to 80 mass parts, or more preferably from 20 to 50 mass parts per 100 mass parts of the crystalline resin.

If the amount of the inorganic fine particle is at least 20 mass parts, some of the inorganic fine particles are more likely to be exposed on the surface of the external toner additive during phase inversion emulsification in the step (iii), while if the amount of the inorganic fine particle is not more than 80 mass parts, the inorganic fine particle is easier to disperse in the liquid dispersion A in the step (i).

Given Rx (nm) as the number-average particle diameter of a primary particle of the inorganic fine particle and Ry (nm) as the number-average particle diameter of a primary particle of the external toner additive, Ry/Rx preferably satisfies the following Formula (5) in the method for manufacturing the external toner additive:

$$5.0 \leq Ry/Rx \leq 100.0 \quad (5).$$

If Ry/Rx is at least 5.0, surface layer adhesion of the external toner additive is promoted because the surface of the resin fine particle is covered to a suitable degree by the inorganic fine particles. If Ry/Rx is not more than 100, the inorganic fine particles are less likely to escape from the inside the resin fine particle. Ry/Rx is more preferably from 6.0 to 20.0, or still more preferably from 6.0 to 18.0.

The number-average particle diameter Rx of a primary particle of the inorganic fine particle is preferably from 10.0 to 70.0 nm, or more preferably from 10.0 to 60.0 nm.

If Rx is at least 10.0 nm, the inorganic fine particles on the surface of the external toner additive form large bumps that serve as point contacts, making it easier to improve toner transferability and increase the density of a solid image. If Rx is not more than 70.0 nm, the external toner additive is easy to manufacture.

Once the external toner additive has been obtained by the steps (i) to (iii), it may also be subjected to hydrophobic treatment. Specifically, the surface is preferably treated with an organic silicon compound or silicone oil.

Because treatment with an organic silicon compound or silicone oil increases the hydrophobicity of the external additive, it can yield a toner having stable developing performance even in high-temperature, high-humidity environments. Surface treatment can be accomplished by chemical treatment with an organic silicon compound that reacts with or is physically adsorbed by the surface of the external toner additive to thereby impart hydrophobicity.

In a preferred method, a silica fine particle produced by vapor phase oxidation of a silicon halogen compound is treated with an organosilicon compound. Examples of the organosilicon compound include the following.

Examples include dimethyl disilazane, hexamethyl disilazane, methyl trimethoxysilane, octyl trimethoxysilane, isobutyl trimethoxysilane, trimethylsilane, trimethyl chlorosilane, trimethyl ethoxysilane, dimethyl dichlorosilane, methyl trichlorosilane, allyldimethyl chlorosilane, allylphenyl dichlorosilane, benzyl dimethyl chlorosilane, bromomethyl dimethyl chlorosilane, α-chloroethyl trichlorosilane, β-chloroethyl trichlorosilane, chloromethyl dimethyl chlorosilane, triorganosilyl mercaptane, trimethylsilyl mercaptane, triorganosilyl acrylate, vinyl dimethyl acetoxysilane, dimethyl ethoxysilane, dimethyl dimethoxysilane, diphenyl diethoxysilane, 1-hexamethyl disiloxane, 1,3-divinyltetramethyl disiloxane, 1,3-diphenyltetramethyl disiloxane, and dimethylpolysiloxanes having 2 to 12 siloxane units in the molecule and having one hydroxyl group for each Si in a terminal position. One of these or a mixture of two or more may be used.

The inorganic fine particle used in the external toner additive may also have been treated with silicone oil. It may also be treated with silicone oil in addition to the aforementioned hydrophobic treated. Examples of silicone oil include dimethyl silicone oil, methylphenyl silicone oil, α-methylstyrene modified silicone oil, chlorphenyl silicone oil, fluorine modified silicone oil and the like.

The following are examples of the method of silicone oil treatment: a method in which an inorganic fine particle such as a silica particle that has been treated with a silane coupling agent is directly mixed with a silicone oil in a mixer such as a Henschel mixer; a method in which a silicone oil is sprayed on the inorganic fine particle as a base; or a method in which a silicone oil is first dissolved or dispersed in a suitable solvent, the inorganic fine particle is added and mixed, and the solvent is then removed.

A toner using the external toner additive of the invention is explained next. The toner of the invention is a toner comprising a toner particle containing a binder resin and a colorant, with an external toner additive on the surface of the toner particle, wherein the external toner additive includes the external toner additive described above.

A known binder resin may be used, without any particular limitations. Examples include monopolymers of styrenes and substituted polystyrenes, such as polystyrene, poly-p-chlorstyrene and polyvinyltoluene; styrene copolymers such as styrene-p-chlorostyrene copolymer, styrene-vinyltoluene copolymer, styrene-vinylnaphthalene copolymer, styrene-acrylic acid ester copolymer and styrene-methacrylic acid ester copolymer; and polyvinyl chloride, phenol resin, natural resin-modified phenol resin, natural resin-modified maleic acid resin, acrylic resin, methacrylic resin, polyvinyl acetate, silicone resin, polyurethane resin, polyamide resin, furan resin, epoxy resin, xylene resin, polyethylene resin, polypropylene resin and the like.

A polyester resin is preferred, and an amorphous polyester resin is especially preferred.

The polyester resin is preferably a condensation polymer of an alcohol component and an acid component. The following compounds are examples of monomers for producing the polyester resin.

Examples of alcohol components include the following bivalent alcohols: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and the bisphenol represented by Formula (I) below and its derivatives.

Examples of trivalent and higher polyvalent alcohol components include 1,2,3-propanetriol, trimethylolpropane, hexanetriol, pentaerythritol and the like.

(I)

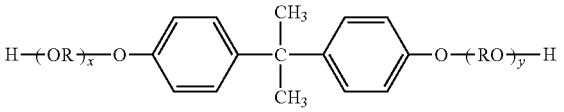

(In the formula, R represents an ethylene or propylene group, X and Y are each 0 or an integer greater than 0, and the average value of X+Y is from 0 to 10.)

Examples of the acid component include the following bivalent carboxylic acids: benzene dicarboxylic acids such as phthalic acid, terephthalic acid, isophthalic acid and phthalic anhydride, or their anhydrides; alkyl dicarboxylic acids such as succinic acid, adipic acid, sebacic acid and azelaic acid, or their anhydrides; succinic acid substituted with $C_{6-18}$ alkyl or $C_{6-18}$ alkenyl groups, or anhydrides thereof; and unsaturated dicarboxylic acids such as fumaric acid, maleic acid, citraconic acid and itaconic acid, or their anhydrides.

A trivalent or higher polyvalent carboxylic acid is preferably used as the acid component. Examples include 1,2,4-benzenetricarboxylic acid (trimellitic acid), 1,2,4-cyclohexanetricarboxylic acid, 1,2,4-naphthalenetricarboxylic acid, pyromellitic acid, and acid anhydrides or lower alkyl esters of these.

Conventionally known black, yellow, magenta, cyan and other colored pigments and dyes and magnetic bodies and the like may be used as the colorant, without any particular limitations.

The content of the colorant is preferably from 1 to 20 mass parts per 100 mass parts of the binder resin.

The toner may also be a magnetic toner containing a magnetic material. In this case, the magnetic body may also serve as a colorant. Examples of magnetic materials include iron oxides such as magnetite, hematite and ferrite; and metals such as iron, cobalt and nickel, or alloys of these metals with other metals such as aluminum, cobalt, copper, lead, magnesium, tin, zinc, antimony, beryllium, bismuth, cadmium, calcium, manganese, selenium, titanium, tungsten and vanadium, and mixtures of these and the like.

When a magnetic material is used, the content thereof is preferably from 40 to 140 mass parts per 100 mass parts of the binder resin.

The toner may also contain a release agent. Examples of the release agent include the following: low-molecular-weight polyolefins such as polyethylene; silicones having melting points (softening points) when heated; fatty acid amides such oleamide, erucamide, ricinolamide and stearamide; ester waxes such as stearyl stearate; plant waxes such as carnauba wax, rice wax, candelilla wax, Japan wax and jojoba wax; animal waxes such as beeswax; mineral and petroleum waxes such as Montan wax, ozokerite, ceresin, paraffin wax, microcrystalline wax, Fischer-Tropsch wax and ester wax; and modified products of these.

The content of the release agent is preferably from 1 to 25 mass parts per 100 mass parts of the binder resin.

A flowability improver other than the external toner additive may also be added to improve the flowability and charging performance of the toner.

Examples of the flowability improver include fluorine resin powders such as vinylidene fluoride fine powder and polytetrafluoroethylene fine powder; fine silica powders such as wet silica and dry silica, fine titanium oxide powder, fine alumina powder, and treated silica obtained by surface treating these with a silane compound, titanium coupling agent or silicone oil; oxides such as zinc oxide and tin oxide; composite oxides such as strontium titanate, barium titanate, calcium titanate, strontium zirconate and calcium zirconate; and carbonate compounds such as calcium carbonate and magnesium carbonate.

The number-average particle diameter of a primary particle of the flowability improver is preferably from 5 nm to 200 nm in order to impart good flowability and charging performance.

The effects of the external toner additive of the invention can be obtained by externally adding it to the toner particle surface. The method for manufacturing the toner particle is not particularly limited, and for example a pulverization method or a polymerization method such as emulsion polymerization, suspension polymerization or dissolution suspension may be used. The toner of the invention can be obtained by thoroughly mixing the external toner additive and the toner particle in a mixer such as a Henschel mixer.

The amount of the external toner additive of the invention added is preferably from 0.1 to 5.0 mass parts per 100 mass parts of the toner particle.

The mixer may be an FM mixer (Nippon Coke & Engineering Co., Ltd.); Super Mixer (Kawata Co., Ltd.); Ribocone (Okawara Mfg. Co., Ltd.); Nauta Mixer, Turbulizer or Cyclomix (Hosokawa Micron Corporation); Spiral Pin Mixer (Pacific Machinery & Engineering Co., Ltd.); or Loedige mixer (Matsubo Corporation), Nobilta (Hosokawa Micron Corporation) or the like.

In a temperature T [° C.]-storage elastic modulus E'[Pa] obtained by powder dynamic viscoelasticity measurement of the toner; a curve of the change in the storage elastic modulus E' relative to the temperature T (dE'/dT) shows relative minimum values at $-1.0\times10^7$ or less within a temperature range from the onset temperature of the dE'/dT curve to 90° C., and the relative minimum value at the lowest temperature side among the relative minimum values is preferably not more than $-9.0\times10^7$, or more preferably not more than $-9.5\times10^7$.

There is no particular lower limit, but preferably it is at least $-20.0\times10^7$, or more preferably at least $-18.0\times10^7$.

This powder dynamic viscoelasticity measurement can measure the viscoelasticity of the toner in a powder state, and the storage elastic modulus E' [Pa] shown by this measurement is thought by the inventors to indicate the melting state of the toner.

FIG. 1 shows an example of the temperature T [° C.]-storage elastic modulus E' [Pa] curve obtained by powder dynamic viscoelasticity measurement of the toner. It can be seen from FIG. 1 that a two-stage drop in the storage elasticity modulus occurs when the storage elasticity modulus of the toner is measured against temperature in powder dynamic viscoelasticity measurement. The inventors believe that the reason for the two-stage drop is that melting near the toner particle surface and melting of the toner particle as a whole appear at different points.

When the toner is subject to external heat, the area near the toner particle surface naturally receives the heat first, so the drop in the storage elastic modulus on the low-temperature end is thought to represent melting near the surface of the toner particle. The rate of decline in the storage elastic modulus relative to temperature signifies the speed of toner melting.

Thus, the "relative minimum value at the lowest temperature side" is thought to represent the potential melting properties near the surface of the toner particle. The larger this value on the negative side, the greater the change in the storage elastic modulus of the toner relative to temperature, indicating strong melting performance near the surface of the toner particle.

The relative minimum value can be controlled by controlling the amount added and melting point of the external toner additive of the invention and the type of the crystalline resin. One way of increasing this relative minimum value on the negative side is to use a crystalline resin with a low melting point.

The various physical property measurements in the present invention are explained below.

Methods for Measuring Melting Point of Crystalline Resin and Maximum Endothermic Peak Temperature and Maximum Exothermic Peak Temperature of External Toner Additive The melting point, maximum endothermic peak temperature and maximum exothermic peak temperature are measured in accordance with ASTM D3418-82 using a Q1000 differential scanning calorimeter (TA Instruments). The melting points of indium and zinc are used for temperature correction of the device detection part, and the heat of fusion of indium is used for correction of the calorific value.

5 mg of sample (external toner additive, crystalline resin) is weighed precisely into an aluminum pan, and using an empty aluminum pan for reference, measurement during the first temperature increase is performed within a measurement temperature range of −40° C. to 150° C. at a rate of increase of 10° C./min. In a DSC curve of this first temperature increase, the temperature of the maximum endothermic peak of the DSC curve within the temperature range of −40° C. to 150° C. is the T1 if the sample is the external toner additive, and the melting point if the sample is the crystalline resin.

Following the first temperature increase, the temperature is maintained for 10 minutes at 150° C., and then decreased to −40° C. at a rate of 10° C./min. In a DSC curve of this first temperature decrease, the temperature of the maximum exothermic peak in the DSC curve within the temperature range of 150° C. to −40° C. is the T2.

Method for Measuring Number-Average Particle Diameters of Primary Particles of Inorganic Fine Particle and External Toner Additive The number-average particle diameter is measured using a Zetasizer Nano-ZS (Malvern). This device measures particle diameter by the dynamic light scattering method. The sample to be measured is first diluted to a solid-liquid ratio of 0.10 mass % (±0.02 mass %), collected in a quartz cell and placed in the measurement part. Methyl ethyl ketone is used as the dispersion medium when the sample is the inorganic fine particle, and water when the sample is the resin fine particle or external toner additive. The refractive index of the sample and the refractive index, viscosity and temperature of the dispersion solvent were input into the Zetasizersoftware 6.30 control software as measurement conditions prior measurement. The Dn is taken as the number-average particle diameter.

The refractive index of the inorganic fine particle is taken from the Handbook of Chemistry. For the refractive index of the resin fine particle, the refractive index stored in the control software is used as the refractive index of the resin used in the resin fine particle. However, if no refractive index is stored in the control software the value described in the polymer database (PoLyinfo) of the National Institute for Materials Science is used. The refractive index of the external toner additive is calculated by weight averaging the refractive index of the inorganic fine particle and the refractive index of the resin used in the resin fine particle. The values stored in the control software are selected for the refractive index, viscosity and temperature of the dispersion solvent. In the case of a mixed solvent, the mixed dispersion media are weight averaged.

Measuring Acid Value of Crystalline Resin

The acid value is the number of mg of potassium hydroxide required to neutralize the acid contained in 1 g of sample. The acid value is measured in accordance with HS K 0070-1992, and specifically is measured by the following procedures.

(1) Sample Preparation 1.0 g of phenolphthalein is dissolved in 90 mL of ethyl alcohol (95 vol %), and ion-exchange water is added to a total of 100 mL to obtain a phenolphthalein solution.

7 g of special-grade potassium hydroxide is dissolved in 5 mL of water, and ethyl alcohol (95 vol %) is added to a total of 1 L. Taking care to avoid contact with carbon dioxide and the like, this is placed in an alkali resistant container, left standing for 3 days, and filtered to obtain a potassium hydroxide solution. The resulting potassium hydroxide solution is stored in an alkali-resistant container. The factor of the potassium hydroxide solution is obtained by placing 25 mL of 0.1 mol/L hydrochloric acid in a triangular flask, adding several drops of the phenolphthalein solution, titrating this with the potassium hydroxide solution, and determining the amount of the potassium hydroxide solution required for neutralization. The 0.1 mol/L hydrochloric acid is prepared in accordance with JIS K 8001-1998.

(2) Operations (A) Main Test 2.0 g of pulverized crystalline polyester is weighed precisely into a 200-mL triangular flask, 100 mL of a toluene/ethanol (2:1) mixed solution is added, and the sample is dissolved over the course of 5 hours. Several drops of the phenolphthalein solution are then added as an indicator, and this is titrated with the potassium hydroxide solution. Titration is considered to be complete when the light pink color of the indicator persisted for about 30 seconds.

(B) Blank Test

Titration is performed by the same operations but without a sample (using only a mixed toluene/ethanol (2:1) solution).

(3) The test results are entered into the following formula to calculate the acid value.

$$A=[(C-B)\times f\times 5.61]/S$$

In the formula, A is the acid value (mg KOH/g), B is the amount (mL) of the potassium hydroxide solution added in the blank test, C is the amount (mL) of the potassium hydroxide solution added in the main test, f is the factor of the potassium hydroxide solution, and S is the sample (g).

Method for Measuring Molecular Weight

The number-average molecular weight Mn of the crystalline resin is measured as follows by gel permeation chromatography (GPC).

First, the crystalline resin is dissolved in toluene at 50° C. over the course of 24 hours. The resulting solution is then filtered with a solvent-resistant membrane filter (Sample Pretreatment Cartridge, Tosoh Corporation) having a pore diameter of 0.2 μm to obtain a sample solution. The concentration of toluene-soluble components in the sample solution is adjusted to about 0.8 mass %. Measurement is performed under the following conditions using this sample solution.

System: HLC8120 GPC (detector: RI) (Tosoh Corporation)

Columns: Shodex KF-801, 802, 803, 804, 805, 806, 807 (total 7) (Showa Denko K.K.)

Eluent: Toluene

Flow rate: 1.0 mL/min

Oven temperature: 50.0° C.

Sample injection volume: 0.10 mL

A molecular weight calibration curve prepared using standard polystyrene resin (trade name TSK standard polystyrene 850, F-450, F-288, F-128, F-80, F-40, F-20, F-10, F-4, F-2 F-1 A-5000, A-2500, A-1000, A-500, Tosoh Corporation) is used for calculating the molecular weights of the samples.

Method for Measuring Hydrophobicity of Inorganic Fine Particle

This is determined from a methanol drip permeability curve obtained as follows.

First, 70 mL of water is placed in a cylindrical glass container 1.75 mm thick and 5 cm in diameter, and dispersed for 5 minutes with an ultrasound disperser to remove air bubbles and the like.

Next, 0.1 g of the inorganic fine particle is weighed exactly and added to the container with the water to prepare a sample solution for measurement.

The sample solution for measurement is then set in a WET-100 P powder wettability measurement unit (Rhesca Co., Ltd.). This sample solution for measurement is stirred at a speed of 6.7 $s^{-1}$ (400 rpm) with a magnetic stirrer. The rotor of the magnetic stirrer is a 25 mm-long spindle rotor with a maximum bore of 8 mm coated with fluorine resin.

Figure 2:
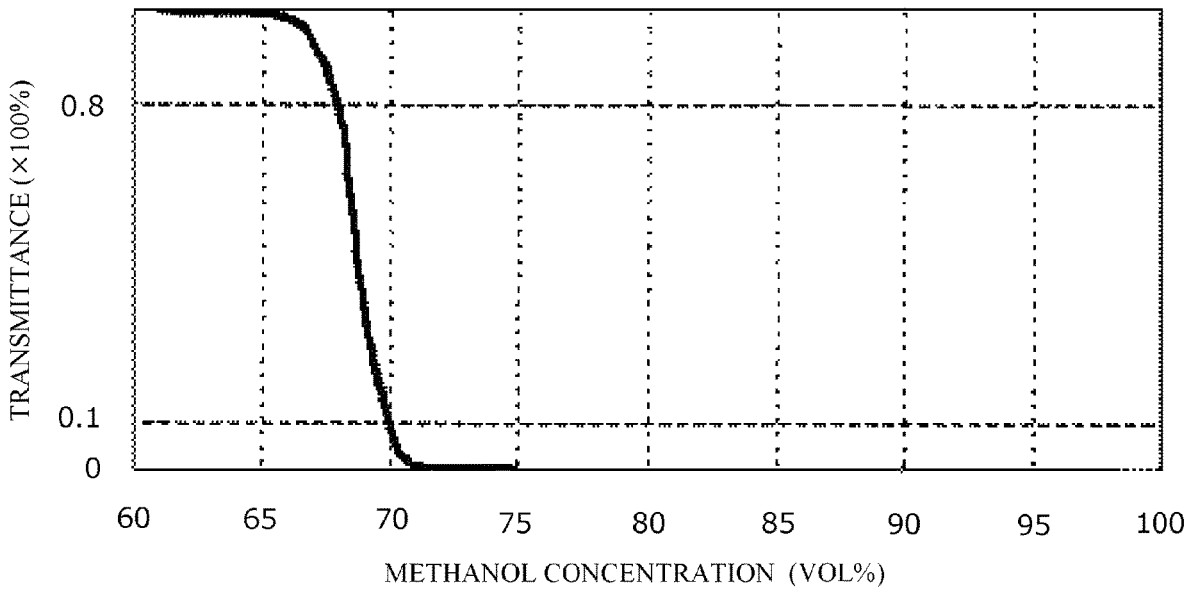
FIG. 2 is a graph showing transmittance against methanol concentration.

Next, methanol is dripped continuously at a rate of 1.3 mil/min through the aforementioned unit into the sample solution for measurement as light transmittance is measured at a wavelength of 780 nm, and a methanol drip permeability curve is prepared as shown in FIG. 2.

The methanol concentration when transmittance is 50% of transmittance at the start of dripping is taken as the degree of hydrophobicity.

Method for Measuring Weight-average Particle Diameter (D4) of Toner Particle

The weight-average particle diameter (D4) of the toner particle is calculated as follows, A Coulter Counter Multisizer® 3 (Beckman Coulter, Inc.) precision particle size distribution measurement device based on the pore electrical resistance method and equipped with a 100 μm aperture tube is used as the measurement device. The Multisizer 3 Version 3.51 dedicated software (Beckman Coulter, Inc.) attached to the device is used to set the measurement conditions and analyze the measurement data. Measurement is performed with 25,000 effective measurement channels.

A solution of special-grade sodium chloride dissolved to a concentration of about 1 mass % in ion-exchange water, such as "Isoton II" (Beckman Coulter, Inc.), may be used as the electrolytic solution for measurement.

The following settings are performed on the dedicated software prior to measurement and analysis.

On the "Change Standard Operating Method (SOM)" screen of the dedicated software, the total count in control mode is set to 50,000 particles, the number of measurements to one, and the Kd value to a value obtained using "Standard Particles 10.0 μm" (Beckman Coulter, Inc.). The threshold and noise level are set automatically by pressing the "threshold/noise level measurement button". The current is set to 1600 μA, the gain to 2, and the electrolytic solution to Isoton II, and a check is entered for "aperture tube flush after measurement".

On the "Conversion Setting from Pulse to Particle Diameter" screen of the dedicated software, the bin interval is set to the logarithmic particle diameter, the particle diameter bin is set to the 256 particle diameter bin, and the particle diameter range is set to 2 μm to 60 μm.

The specific measurement methods are as follows.

(1) About 200 mL of the aqueous electrolytic solution is placed in a 250-mL glass round-bottomed beaker dedicated to the Multisizer 3, set on a sample stand, and stirred with a stirrer rod counterclockwise at a rate of 24 rotations/second. Contamination and bubbles in the aperture tube are removed by means of the "Aperture tube flush" function of the analytical software.

(2) Approximately 30 mL of the aqueous electrolytic solution is placed in a 100-mL glass flat-bottom beaker, and approximately 0.3 mL of a diluted solution of "CONTAMINON N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) diluted 3 times by mass with ion exchanged water is added thereto as a dispersant.

(3) An ultrasonic disperser, "Ultrasonic Dispersion System Tetora 150" (Nikkaki-Bios Co., Ltd.), with an electric output of 120 W equipped with two built-in oscillators with an oscillation frequency of 50 kHz in which the phases of the oscillators are shifted by 180° to each other is provided. A water bath of the ultrasonic disperser is charged with about 3.3 L of ion exchanged water, to which about 2 mL of the CONTAMINON N is added.

(4) The beaker of (2) is set in a beaker-fixing hole of the ultrasonic disperser, and the ultrasonic disperser is operated. The height position of the beaker is adjusted so as to maximize the resonance state of the surface of the electrolytic solution in the beaker.

(5) The electrolytic solution in the beaker of (4) is exposed to ultrasound waves as approximately 10 mg of the toner is added little by little to the electrolytic solution and dispersed. Ultrasonic dispersion treatment is then continued for a further 60 seconds. During the ultrasonic dispersion, the temperature of the water in the water bath is adjusted as necessary so as to be within the range from 10° C. to 40° C.

(6) Using a pipette, the electrolytic solution of (5) with the toner dispersed therein is added dropwise to the round-bottom beaker of (1) disposed on the sample stand, and the measurement concentration is adjusted to about 5%. Measurement is then performed until the number of measured particles reaches 50,000.

(7) The measurement data is analyzed with the dedicated software attached to the apparatus, and the weight-average particle diameter (D4) is calculated. The weight-average particle diameter (D4) is the "average diameter" on the "Analysis/volume statistical value (arithmetic average)" screen when graph/vol % is set by the dedicated software.

Method for Measuring pKa 0.100 g of the neutralizing agent is weighed exactly into a 250-mL tall beaker, 150 mL of water is added, and the mixture is dissolved for 30 minutes to prepare an aqueous neutralizing agent solution. A pH electrode is placed in the aqueous neutralizing agent solution to read the pH of the aqueous solution of the sample. A 0.1 mol/L ethyl alcohol solution of potassium hydroxide (Kishida Chemical Co., Ltd.) is added in 10 μl increments to the aqueous neutralizing agent solution, and the pH is read and titration performed each time. The 0.1 mol/L ethyl alcohol solution of potassium hydroxide is added until the pH reaches 14 or more and there is no further change in pH even when 30 μl is added.

Based on the results, the pH is plotted against the amount of the 0.1 mol/L ethyl alcohol solution of potassium hydroxide added to obtain a titration curve. Based on the titration curve, the point where the pH change gradient is the greatest is defined as the neutralization point, and the pH value at the neutralization point is given as the pKa.

Method for Measuring Toner Agglomeration

For the measurement equipment, a Powder Tester (Hosokawa Micron Corporation) was used with a digital display vibration meter (Digi-Vibro Model 1332A, Showa-sokki Co., Ltd.) attached to the side of the vibrating stand. A sieve with a mesh size of 38 μm (400 mesh), a sieve with a mesh size of 75 μm (200 mesh) and a sieve with a mesh size of 150 μm (100 mesh) were then set in that order from bottom to top on the vibrating stand of the Powder Tester.

(1) The vibration amplitude of the vibrating stand was adjusted in advance so that the displacement value of the digital display vibration meter was 0.60 mm (peak-to-peak).

(2) 5 g of toner that had been left for 24 hours in a 23° C., 60% RH environment were weighed exactly, and gently placed on the uppermost 150 μm mesh sieve.

(3) The sieve was vibrated for 15 seconds, the mass of the toner remaining on the sieve was measured, and agglomeration was calculated based on the following formula.

(Agglomeration (%))={(mass (g) of sample on 150 μm mesh sieve)/5(g)}×100+{(mass (g) of sample on 75 μm mesh sieve)/5 (g))×100×0.06+((mass (g) of sample on 38 μm mesh sieve)/5 (g)}×100×0.2

Method for Measuring Powder Dynamic Viscoelasticity

A DMA8000 (Perkin Elmer) is used as the measurement device. Measurement is performed using a single cantilever (product No. N533-0300) with an N533-0267 oven.

About 50 mg of toner is first weighed exactly, and loaded into the accessory material pocket (product No. N533-0322) so that the toner is in the center of the pocket. A fixing jig is then attached to the geometry shaft so that the fixing jig straddles the temperature sensor and the distance between the drive shaft and the fixing jig is 18.0 mm. The material pocket containing the toner is then clamped with the fixing jig so that center of the pocket is centered with the fixing jig and the drive shaft, and the sample is measured.

The measurement conditions are set as follows using the measurement wizard.

Oven: Standard Air Oven

Measurement type: Temperature scan

Deformation mode: Single cantilever

Frequency: Single frequency 1 Hz
Amplitude: 0.05 mm
Program speed: 2° C./min
Initial temperature: 30° C.
Final temperature: 180° C.
Cross-section: Rectangle
Dimensions of test piece: 17.5 mm (length)×7.5 mm (width)×1.5 mm (thickness)
Data collection interval: 0.3 second interval In a temperature T [° C.]-storage elastic modulus E' [Pa] curve obtained by powder dynamic viscoelasticity measurement of the toner, the change in the storage elastic modulus E' relative to the temperature T (dE'/dT) is measured during about 1.5 seconds before and after the time at each temperature.

The change (dE'/dT) is measured within a temperature range from the onset temperature to 90° C. by the above method, and a temperature [° C.]–change (dE'/dT) graph is prepared skipping two points from the initial data in each plot. The relative minimum values in this graph at or below $-1.0\times10^7$ are measured, and the relative minimum value that appears first at the low-temperature end is calculated.

EXAMPLES

The present invention is explained in more detail below with reference to Examples and Comparative Examples, but the present invention is not limited to these. Unless otherwise specified, parts and percentages referring to the materials below are based on mass.

Manufacturing Example of Crystalline Resin 1

| | |
|---|---|
| Decanedicarboxylic acid | 124.0 parts |
| 1,6-hexandiol | 66.3 parts |
| Trimellitic acid | 9.7 parts |

These raw materials were loaded into a reaction vessel equipped with a stirrer, a thermometer and a nitrogen inlet tube. 0.1 part of tetraisobutyl titanate was then added relative to the total amount of these raw materials, and the mixture was reacted for 4 hours at 180° C., heated to 210° C. at a rate of 10° C./hour, maintained for 8 hours at 210° C., and then reacted for 1 hour at 8.3 kPa to obtain a crystalline resin 1. The physical properties of the crystalline resin 1 are shown in Table 1.

Manufacturing Examples of Crystalline Resins 2 to 10

Crystalline resins 2 to 10 were obtained by altering the monomer formulation from the manufacturing example of crystalline resin 1 as shown in Table 1, and adjusting the reaction conditions. The physical properties of the crystalline resins 2 to 10 are shown in Table 1.

TABLE 1

| Crystalline resin No. | Decanedicarboxylic acid | Sebacic acid | Terephthalic acid | 1,4-butanediol | 1,6-hexanediol | Trimellitic acid | Melting point [° C.] | Acid value | Number-average molecular weight Mn |
|---|---|---|---|---|---|---|---|---|---|
| 1 | 124.0 | — | — | — | 66.3 | 9.7 | 66.0 | 10.0 | 15800 |
| 2 | 131.9 | — | — | — | 66.3 | 1.8 | 63.0 | 3.0 | 15500 |
| 3 | 131.3 | — | — | — | 66.3 | 2.4 | 66.0 | 7.0 | 15800 |
| 4 | 116.2 | — | — | — | 66.3 | 17.5 | 63.0 | 18.0 | 15800 |
| 5 | 112.5 | — | — | — | 66.2 | 21.3 | 64.0 | 22.0 | 14000 |
| 6 | 107.6 | — | — | — | 66.2 | 26.2 | 65.0 | 27.0 | 14000 |
| 7 | 102.5 | — | — | — | 66.5 | 31.0 | 66.0 | 32.0 | 21100 |
| 8 | — | 118.0 | — | — | 71.6 | 10.4 | 59.0 | 10.5 | 20700 |
| 9 | — | — | 112.5 | — | 76.4 | 11.1 | 105.0 | 10.8 | 17600 |
| 10 | — | 128.5 | — | 60.2 | — | 11.3 | 49.0 | 10.5 | 16600 |

In the table, the acid value units are mg KOH/g.

Manufacturing Example of Amorphous Resin 1

| | |
|---|---|
| Bisphenol A propylene oxide adduct (2.2 mol adduct) | 60.0 parts |
| Bipshenol A ethylene oxide adduct (2.2 mol adduct) | 40.0 parts |
| Terephthalic acid | 77.0 parts |

These raw materials were loaded into a 5-liter autoclave equipped with a stirrer, a thermometer and a nitrogen inlet tube. 0.2 parts of dibutyl tin oxide were added relative to the total amount of the raw materials, and nitrogen gas was introduced into the autoclave as a polycondensation reaction was performed at 230° C. The reaction time was adjusted to obtain the desired softening point, and after completion of the reaction the product was removed from the vessel, cooled, and pulverized to obtain an amorphous resin 1 (glass transition temperature Tg: 59° C., softening point Tm: 112° C.).

Manufacturing Example of Hydrophobic Agent Solution 1

0.1 part of dimethyl disilazane was dissolved in 1.0 part of isopropyl alcohol to obtain a hydrophobic agent solution 1.

Neutralizing Agent

The neutralizing agents shown in Table 2 were used.

TABLE 2

| | Type | pKa | Boiling point [° C.] |
|---|---|---|---|
| Neutralizing agent 1 | Triethylamine | 10.8 | 90 |
| Neutralizing agent 2 | Ammonia water | 9.3 | −33 |
| Neutralizing agent 3 | Dimethylaminoethanol | 9.2 | 133 |

TABLE 2-continued

| | Type | pKa | Boiling point [° C.] |
|---|---|---|---|
| Neutralizing agent 4 | Triethanolamine | 7.8 | 208 |
| Neutralizing agent 5 | Butylamine | 12.5 | 78 |

Inorganic Fine Particle Dispersion

The inorganic fine particle dispersions shown in Table 3 below were used. The inorganic fine particle dispersions were solidified by drying, and the solids contents were measured from the change in weight after drying. The agglomerate of inorganic fine particle obtained by dry solidification was pulverized in a freeze pulverizer, and thoroughly dried and crushed to obtain an inorganic fine particle. A wettability test of the inorganic fine particle with methanol was performed to measure hydrophobicity. The number-average particle diameter, hydrophobicity, and solids content are shown in Table 3. The inorganic fine particle dispersions 1 to 6 are dispersed in a mixed solvent of methyl ethyl ketone and methanol.

TABLE 3

| | Type | Number-average particle diameter Rx of primary particle [nm] | Hydrophobicity [methanol vol %] | Solids content [mass %] | Dispersion medium |
|---|---|---|---|---|---|
| Inorganic fine particle dispersion 1 | MEK-ST -40 (Nissan Chemical Industries, Ltd.) | 15 | 15 | 40 | MEK/MeOH = 98/2 |
| Inorganic fine particle dispersion 2 | MEK-ST -L (Nissan Chemical Industries, Ltd.) | 50 | 15 | 30 | MEK/MeOH = 99/1 |
| Inorganic fine particle dispersion 3 | MEK-ST -ZL (Nissan Chemical Industries, Ltd.) | 100 | 15 | 30 | MEK/MeOH = 99/1 |
| Inorganic fine particle dispersion 4 | Silica fine particle 1 | 15 | 27 | 30 | MEK/MeOH = 99/1 |
| Inorganic fine particle dispersion 5 | Silica fine particle 2 | 15 | 32 | 30 | MEK/MeOH = 99/1 |
| Inorganic fine particle dispersion 6 | Silica fine particle 3 | 15 | 70 | 30 | MEK/MeOH = 99/1 |

In the Table 3, MEK/MeOH is mass ratio.

Manufacturing Example of External Toner Additive 1

5.0 parts of the crystalline resin 1 and 10.0 parts of THF were loaded into a reaction vessel equipped with a stirrer, a condenser and a thermometer, and heated and dissolved at 50° C.

After thorough dissolution of the resin had been confirmed, 3.0 parts of the inorganic particle dispersion 1 of Table 3 were added and thoroughly stirred. 0.35 parts of triethylamine were then added as neutralizing agent 1 under stirring to prepare a co-dispersion 1. 75 parts of water were added dropwise to the co-dispersion 1 at a rate of 2.5 g/minute to perform phase inversion emulsification, after which the THF was thoroughly distilled off with an evaporator at 40° C. Ultrafiltration was then performed to remove excess neutralizing agent, and concentration/filtration were repeated for a total of 5 times. Water was further added under ultrasound to obtain an external toner additive dispersion 1 (solid concentration 5.0 mass %). The number-average particle diameter as measured with a Zetasizer was 190 nm.

1.0 part of the hydrophobic agent solution 1 was then added to the external toner additive dispersion 1, which was then stirred for 2 hours at 30.0° C. This was then centrifuged for 10 minutes at 12,000 rpm, and the precipitate was collected and vacuum dried to obtain an external toner additive 1. The T1, T2, T1-T2 and number-average particle diameter of the external toner additive 1 were measured. The physical properties are shown in Table 5.

Manufacturing Examples of External Toner Additives 2 to 30

External toner additives 2 to 30 were obtained as in the manufacturing example of the external toner additive 1 except that the type of the crystalline resin, the type and amount added of the inorganic fine particle dispersion, the type and amount added of the neutralizing agent and the type and amount added of the surfactant in the manufacturing example of the external toner additive 1 were changed as shown in Table 4. When a surfactant was used, it was dissolved in the water for adding to the co-dispersion after addition of the neutralizing agent. The physical properties are shown in Table 5.

TABLE 4

| | Crystalline resin | | Inorganic fine particle dispersion | | Neutralizing agent | | Surfactant | |
|---|---|---|---|---|---|---|---|---|
| | No. | Parts | No. | Parts | No. | Parts | Type | Parts |
| External toner additive 1 | 1 | 5.0 | 1 | 3.0 | 1 | 0.35 | — | — |
| External toner additive 2 | 2 | 5.0 | 1 | 3.0 | 1 | 0.35 | — | — |
| External toner additive 3 | 3 | 5.0 | 1 | 3.0 | 1 | 0.35 | — | — |
| External toner additive 4 | 4 | 5.0 | 1 | 3.0 | 1 | 0.35 | — | — |
| External toner additive 5 | 5 | 5.0 | 1 | 3.0 | 1 | 0.35 | — | — |
| External toner additive 6 | 6 | 5.0 | 1 | 3.0 | 1 | 0.35 | — | — |
| External toner additive 7 | 1 | 5.0 | 1 | 4.5 | 1 | 0.35 | — | — |
| External toner additive 8 | 1 | 5.0 | 1 | 6.0 | 1 | 0.35 | — | — |
| External toner additive 9 | 1 | 5.0 | 1 | 6.8 | 1 | 0.35 | — | — |
| External toner additive 10 | 1 | 5.0 | 1 | 3.0 | 2 | 0.35 | — | — |
| External toner additive 11 | 1 | 5.0 | 1 | 3.0 | 3 | 0.35 | — | — |
| External toner additive 12 | 1 | 5.0 | 1 | 3.0 | 4 | 0.35 | — | — |
| External toner additive 13 | 1 | 5.0 | 1 | 3.0 | 5 | 0.35 | — | — |
| External toner additive 14 | 1 | 5.0 | 2 | 3.0 | 1 | 0.35 | — | — |
| External toner additive 15 | 8 | 5.0 | 1 | 3.0 | 1 | 0.35 | — | — |
| External toner additive 16 | 9 | 5.0 | 1 | 3.0 | 1 | 0.35 | — | — |
| External toner additive 17 | 1 | 5.0 | 4 | 3.0 | 1 | 0.35 | — | — |
| External toner additive 18 | 1 | 5.0 | 1 | 3.0 | 1 | 0.50 | — | — |
| External toner additive 19 | 1 | 5.0 | 1 | 3.0 | 1 | 0.65 | — | — |
| External toner additive 20 | 1 | 5.0 | 1 | 3.0 | 1 | 0.35 | SDS | 0.015 |
| External toner additive 21 | 1 | 5.0 | 1 | 3.0 | 1 | 0.35 | SDS | 0.045 |
| External toner additive 22 | 7 | 5.0 | 1 | 3.0 | 1 | 0.35 | — | — |
| External toner additive 23 | 1 | 5.0 | 1 | 8.3 | 1 | 0.35 | — | — |
| External toner additive 24 | 1 | 5.0 | 1 | 10.5 | 1 | 0.35 | — | — |
| External toner additive 25 | 1 | 5.0 | 1 | 3.0 | 1 | 0.35 | SDS | 0.10 |
| External toner additive 26 | 1 | 5.0 | 3 | 3.0 | 1 | 0.35 | — | — |
| External toner additive 27 | 1 | 5.0 | 1 | 3.0 | 1 | 1.0 | — | — |
| External toner additive 28 | 10 | 5.0 | 1 | 3.0 | 1 | 0.35 | — | — |
| External toner additive 29 | 1 | 5.0 | 5 | 3.0 | 1 | 0.35 | — | — |
| External toner additive 30 | 1 | 5.0 | 6 | 3.0 | 1 | 0.35 | — | — |
| External toner additive 34 | 1 | 5.0 | 6 | 3.0 | — | — | SDS | 0.30 |

In the table, SDS represents sodium dodecylsulfonate.

Manufacturing Example of External Toner Additive 31

3.0 parts of sodium dodecylsulfonate (SDS) and 150.0 parts of water were added to a vessel equipped with a stirrer, a condenser and a thermometer, and dissolved. 95.0 parts of styrene were then added dropwise at a rate of 3.0 parts/minute to prepare an emulsion. The temperature of the emulsion was raised to 80° C., 0.6 parts of potassium persulfate dissolved in 10.0 parts of water were added, and polymerization was performed for 2 hours.

The emulsion was then cooled to 40° C., and stirred for 2 hours after addition of 5.0 parts of divinyl benzene, after which the temperature was raised to 85° C., 0.1 part of potassium persulfate dissolved in 2.0 parts of water was added, a polymerization reaction was performed for 4 hours, and an aqueous hydroquinone solution was added as a reaction terminator to stop polymerization. The polymer conversion rate at this point was 99%.

The water-soluble matter was removed by ultrafiltration, and the pH and concentration were adjusted to obtain a resin fine particle dispersion with a solids concentration of 50% and a pH of 8.5.

The resulting 2.0 parts of the resin fine particle dispersion were added to 100.0 parts of methanol, and 7.5 parts of tetraethoxysilane were dissolved in as a hydrophobic agent. This was heated as is to 50° C., and stirred for 1 hour. 20.0 parts of a 28 mass % aqueous $NH_4OH$ solution was then added with dripping to this solution, and stirred for 48 hours at room temperature to perform a sol-gel reaction and coat the surfaces of the resin fine particles with siloxane. After completion of the reaction, this was washed with water and then with methanol, filtered, and dried of 40 kPa for 24 hours at 45° C.

The entire amount was then dispersed in 6.0 parts of toluene, 0.01 part of 3-aminopropyl triethoxysilane (silicon compound containing amino groups) was added, and the mixture was dispersed and mixed for 15 minutes. 0.01 part of hexamethyldisilazane was then added, and dispersed and mixed for 15 minutes to bring it into contact with the fine particle. This dispersion was vacuum distilled, and dried to obtain an external toner additive 31. The physical property values are shown in Table 5.

Manufacturing Example of External Toner Additive 32

100.0 parts of wax (Hi-Wax 100P (Mitsui Chemicals, Inc., molecular weight 900, melting point 116° C., softening point 121° C.)), 900.0 parts of water and 2.0 parts of ethylene glycol monostearate were added to a vessel provided with a stirrer, a condenser, a thermometer and a Clearmix (M Technique Co., Ltd.), and stirred at 90° C. This was then dispersed for 10 minutes with the Clearmix at a rotational speed of 10,000 rpm, to obtain a wax fine particle dispersion. Next, the wax fine particle dispersion was cooled to 40° C., and vacuum dried at 25° C. in a vacuum dryer to obtain a wax fine particle.

100.0 parts of the wax fine particle and 20.0 parts of fumed silica (BET: 200 $m^2/g$) were mixed with a multipurpose mixer (MP5, Nippon Coke & Engineering Co., Ltd.) to attach the fumed silica to the surface of the wax fine particle and obtain an external toner additive 32. The physical property values are shown in Table 5.

Manufacturing Example of External Toner Additive 33

100.0 parts of crystalline resin 1, 50.0 parts of methyl ethyl ketone and 25.0 parts of 2-propanol were placed in a vessel provided with a stirrer, a condenser, a thermometer and a nitrogen inlet tube, and dissolved under thorough stirring at 50° C. 3.5 parts of 10 mass % ammonia water were then added, and the mixture was stirred for at least 10 minutes to obtain a crystalline resin solution 2.

This was then heated to 72° C., and 1.0 part/minute of water was dripped into the crystalline resin solution 2 under stirring to perform phase inversion emulsification. After completion of water dripping, this was bubbled for 24 hours with dry nitrogen at 25° under stirring at 70 rpm to remove the solvent and obtain an external toner additive dispersion 33. The total amount of this external toner additive dispersion 33 was then freeze dried to obtain an external toner additive 33. The physical property values are shown in Table 5.

Manufacturing Example of External Toner Additive 34

5.0 parts of the crystalline resin 1 and 10.0 parts of toluene were loaded into a reaction vessel equipped with a stirrer, a condenser and a thermometer, and heated and dissolved at 50° C. to prepare a crystalline resin solution 1. After thorough dissolution of the resin had been confirmed, 3.0 parts of the inorganic fine particle dispersion 6 of Table 3 were added, and thoroughly stirred. The crystalline resin solution 1 was added to a water phase comprising 0.3 parts of sodium dodecylsulfonate dissolved in 100 parts of water, and dispersed for 10 minutes at 12,000 rpm with a rotary homogenizer (T50 Ultra-Turrax, IKA®-Werke GmbH & Co. KG).

The toluene was thoroughly distilled off with an evaporator at 40° C. Ultrafiltration was then performed to remove the excess surfactant, and concentration/filtration was repeated for a total of 5 times. Water was then added under ultrasound, to obtain an external toner additive dispersion 34 (solids concentration 5.0 mass %). The number-average particle diameter was 190 nm as measured with a Zetasizer.

1.0 part of the hydrophobic agent solution 1 was added to the external toner additive dispersion 34, and stirred for 2 hours at 30.0° C. This was then centrifuged for 10 minutes at 12,000 rpm, and the precipitate was collected and vacuum dried to obtain an external toner additive 34. The T1, T2, T1-T2 and number-average particle diameter of the external toner additive 34 were measured. The physical property values are shown in Table 5.

TABLE 5

| External toner additive No. | T1 [° C.] | T2 [° C.] | T1 − T2 | Ry [nm] | Ry/Rx | State of inorganic fine particle on surface of external toner additive |
|---|---|---|---|---|---|---|
| 1 | 66.0 | 36.0 | 30.0 | 250 | 16.7 | Embedded |
| 2 | 66.0 | 36.0 | 30.0 | 320 | 21.3 | Embedded |
| 3 | 66.0 | 36.0 | 30.0 | 270 | 18.0 | Embedded |
| 4 | 66.0 | 31.0 | 35.0 | 170 | 11.3 | Embedded |
| 5 | 66.0 | 29.0 | 37.0 | 120 | 8.0 | Embedded |
| 6 | 66.0 | 27.0 | 39.0 | 90 | 6.0 | Embedded |
| 7 | 66.0 | 33.0 | 33.0 | 250 | 16.7 | Embedded |
| 8 | 66.0 | 31.0 | 35.0 | 260 | 17.3 | Embedded |
| 9 | 66.0 | 29.0 | 37.0 | 270 | 18.0 | Embedded |
| 10 | 66.0 | 36.0 | 30.0 | 240 | 16.0 | Embedded |
| 11 | 66.0 | 33.0 | 33.0 | 230 | 15.3 | Embedded |
| 12 | 66.0 | 28.0 | 38.0 | 350 | 23.3 | Embedded |
| 13 | 66.0 | 29.0 | 37.0 | 200 | 13.3 | Embedded |
| 14 | 66.0 | 36.0 | 30.0 | 280 | 5.6 | Embedded |
| 15 | 59.0 | 25.0 | 34.0 | 220 | 14.7 | Embedded |
| 16 | 105.0 | 70.0 | 35.0 | 230 | 15.3 | Embedded |
| 17 | 66.0 | 28.0 | 38.0 | 200 | 13.3 | Embedded |
| 18 | 66.0 | 33.0 | 33.0 | 200 | 13.3 | Embedded |
| 19 | 66.0 | 28.0 | 38.0 | 260 | 17.3 | Embedded |
| 20 | 66.0 | 32.0 | 34.0 | 200 | 13.3 | Embedded |
| 21 | 66.0 | 28.0 | 38.0 | 260 | 17.3 | Embedded |
| 22 | 66.0 | 13.0 | 53.0 | 150 | 10.0 | Embedded |
| 23 | 66.0 | 18.0 | 48.0 | 290 | 19.3 | Embedded |
| 24 | 66.0 | 7.0 | 59.0 | 320 | 21.3 | Embedded |
| 25 | 66.0 | 5.0 | 61.0 | 200 | 13.3 | Embedded |
| 26 | 66.0 | 8.0 | 58.0 | 400 | 4.0 | Embedded |
| 27 | 66.0 | 7.0 | 59.0 | 320 | 21.3 | Embedded |
| 28 | 49.0 | 19.0 | 30.0 | 250 | 16.7 | Embedded |
| 29 | 66.0 | 19.0 | 47.0 | 260 | 17.3 | Embedded |
| 30 | 66.0 | 7.0 | 59.0 | 320 | 21.3 | Embedded |
| 31 | — | — | — | 250 | 16.7 | Coating layer structure |
| 32 | 96.0 | 66.0 | 30.0 | 250 | 16.7 | Coating layer structure |
| 33 | 66.0 | 8.0 | 58.0 | 250 | 16.7 | Resin fine particle |
| 34 | 66.0 | 18.0 | 48.0 | 330 | 22.0 | Embedded |

Manufacturing Example of Toner Particle 1

100.0 parts of the amorphous resin 1 (Tg: 59° C., softening point Tm: 112° C.), 75.0 parts of magnetic iron oxide powder, 2.0 parts of Fischer-Tropsch wax (Sasol C105, melting point: 105° C.) and 2.0 parts of a charge control agent (Hodogaya Chemical Co., Ltd., T-77) were pre-mixed in an FM mixer (Nippon Coke & Engineering Co., Ltd.), and then melt kneaded with a twin-screw extruder (product name: PCM-30, Ikegai Ironworks Corp.) with the temperature set so that the temperature of the molten material at the discharge port was 150° C.

The resulting kneaded product was cooled, coarsely pulverized in a hammer mill, and then finely pulverized in a pulverizer (product name: Turbo Mill T250, Turbo Industries) and classified to obtain a toner particle 1 with a weight-average particle diameter (D4) of 7.2 μm.

Manufacturing Example of Toner 1

1.5 parts of the external toner additive 1 and 0.5 parts of fumed silica (BET: 200 $m^2/g$) treated with hexamethyl disilazane were dry mixed for 5 minutes with 100.0 parts of the toner particle 1 in an FM mixer (Nippon Coke & Engineering Co., Ltd.), and the externally added particles were then sieved with a 150 μm mesh sieve to obtain a toner 1. The physical properties are shown in Table 6.

Manufacturing Examples of Toners 2 to 34

Toners 2 to 34 were obtained as in the manufacturing example of toner 1 except that the external toner additive 1 was changed as shown in Table 6.

TABLE 6

| Toner No. | Toner particle No. | External toner additive No. | Parts | Flowability improver | Parts | Relative Minimum of (dE'/dT) at lowest temperature side [$\times 10^7$] |
|---|---|---|---|---|---|---|
| 1 | 1 | 1 | 1.5 | Fumed silica | 0.5 | −12.0 |
| 2 | 1 | 2 | 1.5 | Fumed silica | 0.5 | −12.0 |
| 3 | 1 | 3 | 1.5 | Fumed silica | 0.5 | −12.0 |
| 4 | 1 | 4 | 1.5 | Fumed silica | 0.5 | −10.0 |
| 5 | 1 | 5 | 1.5 | Fumed silica | 0.5 | −10.0 |
| 6 | 1 | 6 | 1.5 | Fumed silica | 0.5 | −10.0 |
| 7 | 1 | 7 | 1.5 | Fumed silica | 0.5 | −12.0 |
| 8 | 1 | 8 | 1.5 | Fumed silica | 0.5 | −12.0 |
| 9 | 1 | 9 | 1.5 | Fumed silica | 0.5 | −12.0 |
| 10 | 1 | 10 | 1.5 | Fumed silica | 0.5 | −12.0 |
| 11 | 1 | 11 | 1.5 | Fumed silica | 0.5 | −12.0 |
| 12 | 1 | 12 | 1.5 | Fumed silica | 0.5 | −10.0 |
| 13 | 1 | 13 | 1.5 | Fumed silica | 0.5 | −12.0 |
| 14 | 1 | 14 | 1.5 | Fumed silica | 0.5 | −12.0 |
| 15 | 1 | 15 | 1.5 | Fumed silica | 0.5 | −12.0 |
| 16 | 1 | 16 | 1.5 | Fumed silica | 0.5 | −9.5 |
| 17 | 1 | 17 | 1.5 | Fumed silica | 0.5 | −12.0 |
| 18 | 1 | 18 | 1.5 | Fumed silica | 0.5 | −12.0 |
| 19 | 1 | 19 | 1.5 | Fumed silica | 0.5 | −10.0 |
| 20 | 1 | 20 | 1.5 | Fumed silica | 0.5 | −12.0 |
| 21 | 1 | 21 | 1.5 | Fumed silica | 0.5 | −10.0 |
| 22 | 1 | 22 | 1.5 | Fumed silica | 0.5 | −12.0 |
| 23 | 1 | 23 | 1.5 | Fumed silica | 0.5 | −10.0 |
| 24 | 1 | 24 | 1.5 | Fumed silica | 0.5 | −10.0 |
| 25 | 1 | 25 | 1.5 | Fumed silica | 0.5 | −10.0 |
| 26 | 1 | 26 | 1.5 | Fumed silica | 0.5 | −8.0 |
| 27 | 1 | 27 | 1.5 | Fumed silica | 0.5 | −12.0 |
| 28 | 1 | 28 | 1.5 | Fumed silica | 0.5 | −12.0 |
| 29 | 1 | 29 | 1.5 | Fumed silica | 0.5 | −10.0 |
| 30 | 1 | 30 | 1.5 | Fumed silica | 0.5 | −12.0 |
| 31 | 1 | 31 | 1.5 | Fumed silica | 0.5 | −8.0 |
| 32 | 1 | 32 | 1.5 | Fumed silica | 0.5 | −8.0 |
| 33 | 1 | 33 | 1.5 | Fumed silica | 0.5 | −12.0 |
| 34 | 1 | 34 | 1.5 | Fumed silica | 0.5 | −12.0 |

Example 1

The following evaluations were performed with the toner 1 using the main body of a commercial HP LaserJet Enterprise M606dn printer using a magnetic single-component system (Hewlett Packard Company, process speed 350 mm/s), modified so that the process speed was 380 mm/s.

The process cartridge used in the evaluation is an 81X High Yield Black Original LaserJet Toner Cartridge (Hewlett Packard Company). The toner product was removed from inside the designated process cartridge, which was then cleaned by air blowing, and filled with 1200 g of the toner obtained in the example at a high density. Using this, the Toner 1 was then evaluated as follows. Vitality (Xerox, basis weight 75 $g/cm^2$, letter) was used as the evaluation paper.

Evaluation of Low-Temperature Fixability

The fixing unit was removed from the evaluation unit to obtain an external fixing unit on which the temperature could be set at will. Using this unit, with the fixing temperature controlled in 5° C. increments within the range from 170° C. to 220° C., halftone images were output with an image density ranging from 0.60 to 0.65. The image density was measured using an SPI filter with a Macbeth Densitometer, a reflection densitometer manufactured by Macbeth Co. The resulting image was rubbed 5 times back and forth with Silbon paper under 4.9 kPa of load, and the loss of image density after rubbing was measured.

The lowest fixing unit temperature setting at which the image density loss was 10% or less was taken as the fixing initiation temperature of the toner, and used to evaluate low-temperature fixability according to the following standard. Toners with low fixing initiation temperatures have good low-temperature fixability. Low-temperature fixability was evaluated in a normal temperature, normal humidity environment (25.0° C./50% RH). The evaluation results are shown in Table 7.

Evaluation Standard

A: Fixing initiation temperature less than 190° C.
B: Fixing initiation temperature 190° C. to less than 200° C.
C: Fixing initiation temperature 200° C. to less than 210° C.
D: Fixing initiation temperature 210° C. or more Evaluation of Developing Performance The printer above was used with a process cartridge filled with the toner 1, with a fixing temperature of 200° C. An image output test was performed by printing 5,000 copies of an E character pattern with a print percentage of 2%, 2 sheets per job, with the mode set so that the next job started after the machine was stopped temporarily between job and job. From the 5001st to the 5500th copy, a one-sided full solid image was output, and the 500 copies were stacked in the output tray. Output was performed in a high-temperature, high-humidity environment (32.5° C., RH 85%). The image density of the 5500th solid image was measured using an SPI filter with a Macbeth Densitometer, a reflection densitometer manufactured by Macbeth Co. The evaluation results are shown in Table 7.

Evaluation Standard

A: Image density at least 1.35
B: Image density at least 1.25 and less than 1.35
C: Image density at least 1.10 and less than 1.25
D: Image density less than 1.10

Evaluation of Back Soiling

After completion of printing in the "evaluation of image density", the image density of the back of the 5002nd sheet 2 sheets up from the bottom of the stack (part contacting solid image on 5001st sheet) was evaluated. The image density was measured using an SPI filter with a Macbeth Densitometer, a reflection densitometer manufactured by Macbeth Co. The evaluation results are shown in Table 7.

Evaluation Standard

A: Back soiling density less than 0.02
B: Back soiling density 0.02 to less than 0.05
C: Back soiling density 0.05 to less than 0.10
D: Back soiling density 0.10 or more Evaluation of Heat-Resistant Storage Stability 5 g samples of the toner 1 were weighed exactly, and left for 24 hours in a 23° C., 60% RH environment and a 30° C., 80% RH environment. The degree of agglomeration of each of the toners after standing was measured by the "method for measuring toner agglomeration" described above. Given 100% as the agglomeration of the toner left at 23° C., 60/o RH, the increase in the agglomeration of the toner left at 80% RH was used as a benchmark. A lower increase means indicates good heat-resistant storage stability. The evaluation results are shown in Table 7.

Evaluation Standard

A: Agglomeration increase less than 5%

B: Agglomeration increase 5% to less than 10%

C: Agglomeration increase 10%, to less than 200

D: Agglomeration increase 20%, or more

Examples 2 to 21, Comparative Examples 1 to 13

The Toners 2 to 34 were evaluated as in Example 1. The evaluation results are shown in Table 7.

TABLE 7

| | | Low-temperature fixability | | Developing performance | | Image loading capacity | | Heat-resistant storability | |
|---|---|---|---|---|---|---|---|---|---|
| | Toner No. | Rank | Fixing initiation temperature | Rank | Solid black image density | Rank | Density of back soiling | Rank | Agglomeration increase |
| Example 1 | 1 | A | 180 | A | 1.45 | A | 0 | A | 3 |
| Example 2 | 2 | A | 180 | C | 1.23 | A | 0.01 | A | 3 |
| Example 3 | 3 | A | 185 | A | 1.37 | A | 0.01 | A | 3 |
| Example 4 | 4 | B | 190 | A | 1.41 | B | 0.03 | A | 4 |
| Example 5 | 5 | B | 195 | A | 1.42 | B | 0.03 | B | 6 |
| Example 6 | 6 | B | 195 | A | 1.45 | C | 0.05 | C | 10 |
| Example 7 | 7 | A | 185 | A | 1.41 | B | 0.03 | A | 4 |
| Example 8 | 8 | A | 185 | A | 1.42 | B | 0.03 | A | 4 |
| Example 9 | 9 | A | 185 | A | 1.45 | B | 0.03 | B | 6 |
| Example 10 | 10 | A | 180 | A | 1.41 | A | 0.01 | A | 3 |
| Example 11 | 11 | A | 180 | A | 1.41 | A | 0.01 | A | 2 |
| Example 12 | 12 | B | 195 | C | 1.23 | C | 0.05 | A | 2 |
| Example 13 | 13 | A | 185 | B | 1.25 | C | 0.05 | C | 12 |
| Example 14 | 14 | A | 185 | B | 1.27 | B | 0.04 | A | 3 |
| Example 15 | 15 | A | 185 | A | 1.41 | A | 0.01 | B | 5 |
| Example 16 | 16 | C | 205 | A | 1.41 | A | 0.01 | A | 4 |
| Example 17 | 17 | A | 185 | A | 1.41 | B | 0.02 | A | 4 |
| Example 18 | 18 | A | 185 | A | 1.41 | B | 0.02 | A | 4 |
| Example 19 | 19 | B | 195 | A | 1.41 | C | 0.05 | A | 4 |
| Example 20 | 20 | A | 185 | A | 1.41 | B | 0.02 | A | 4 |
| Example 21 | 21 | B | 195 | A | 1.41 | C | 0.05 | A | 4 |
| Comparative Example 1 | 22 | A | 185 | B | 1.25 | D | 0.1 | C | 12 |
| Comparative Example 2 | 23 | B | 195 | B | 1.26 | D | 0.11 | C | 10 |
| Comparative Example 3 | 24 | B | 195 | B | 1.25 | D | 0.11 | C | 13 |
| Comparative Example 4 | 25 | B | 195 | B | 1.26 | D | 0.13 | C | 12 |
| Comparative Example 5 | 26 | D | 215 | B | 1.27 | D | 0.13 | C | 12 |
| Comparative Example 6 | 27 | A | 185 | A | 1.41 | D | 0.11 | D | 21 |
| Comparative Example 7 | 28 | A | 185 | B | 1.25 | D | 0.11 | C | 12 |
| Comparative Example 8 | 29 | B | 195 | A | 1.41 | D | 0.11 | C | 12 |
| Comparative Example 9 | 30 | A | 185 | D | 1.09 | D | 0.15 | A | 4 |
| Comparative Example 10 | 31 | D | 215 | A | 1.41 | D | 0.13 | A | 4 |
| Comparative Example 11 | 32 | D | 215 | D | 1.09 | D | 0.13 | C | 14 |
| Comparative Example 12 | 33 | A | 185 | D | 1.09 | D | 0.15 | C | 14 |
| Comparative Example 13 | 34 | B | 195 | B | 1.26 | D | 0.11 | C | 10 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-23934, filed Feb. 14, 2018, which is hereby incorporated by reference herein in its entirety.

What is claimed is:

1. An external toner additive comprising a resin fine particle containing a crystalline resin and an inorganic fine particle embedded in the resin fine particle, wherein part of the inorganic fine particle is exposed on the surface of the resin fine particle, and in differential scanning calorimetry of the external toner additive, the maximum endothermic peak temperature T1 (° C.) during the first temperature increase and the maximum exothermic peak temperature T2 (° C.) during the first temperature decrease satisfy the following formulae (1) to (3), wherein measurement is performed from −40° C. to 150° C. at a rate of increase in temperature of 10° C./min during the first temperature increase and from 150° C. to −40° C. at a rate of decrease in temperature of 10° C./min during the first temperature decrease:

$$T1-T2 \leq 40.0 \quad (1)$$

$$50.0 \leq T1 \leq 120.0 \quad (2)$$

$$10.0 \leq T2 \leq 80.0 \quad (3).$$

2. The external toner additive according to claim 1, wherein the maximum exothermic peak temperature T2 [° C.] satisfies the following formula (4):

$$20.0 \leq T2 \leq 80.0 \quad (4).$$

3. The external toner additive according to claim 1, wherein the number-average particle diameter of a primary particle of the external toner additive as measured by the dynamic light scattering method is from 50 nm to 300 nm.

4. The external toner additive according to claim 1, wherein the inorganic fine particle is at least one selected from the group consisting of a silica fine particle, an alumina fine particle, a titania fine particle, a zinc oxide fine particle, a strontium titanate fine particle, a calcium carbonate fine particle and a cerium oxide fine particle.

5. The external toner additive according to claim 1, wherein the crystalline resin contains a crystalline polyester.

6. A toner comprising a toner particle containing a binder resin and a colorant, and an external toner additive on the surface of the toner particle, wherein the external toner additive comprises an external toner additive according to claim 1.

7. The toner according to claim 6, wherein in a temperature T [° C.]-storage elastic modulus E' [Pa] curve obtained by powder dynamic viscoelasticity measurement of the toner, a curve of the change in the storage elastic modulus E' relative to the temperature T (dE'/dT) shows relative minimum values at $-1.0\times10^7$ or less within a temperature range from the onset temperature of the dE'/dT curve to 90° C., and the relative minimum value at the lowest temperature side among the relative minimum values is not more than $-9.0\times10^7$.

8. A method for producing an external toner additive comprising a resin fine particle containing a crystalline resin and an inorganic fine particle embedded in the resin fine particle, in which part of the inorganic fine particle is exposed on the surface of the resin fine particle, comprising a step (i) of preparing a liquid dispersion A comprising the inorganic fine particle dispersed in a solution in which the crystalline resin is dissolved in an organic solvent, a step (ii) of preparing a liquid dispersion B by adding a neutralizing agent with an acid dissociation constant pKa of at least 7.0 to the liquid dispersion A, and a step (iii) of adding water to the liquid dispersion B to prepare a liquid dispersion C comprising the external toner additive dispersed by phase inversion emulsification, wherein in differential scanning calorimetry of the external toner additive, the maximum endothermic peak temperature T1 (° C.) during the first temperature increase satisfies the following formula (2):

$$50\leq T1\leq 120.0 \quad (2).$$

9. The method for producing an external toner additive according to claim 8, wherein the acid dissociation constant pKa of the neutralizing agent is from 9.0 to 13.0.

10. The method for producing an external toner additive according to claim 8, wherein the boiling point of the neutralizing agent is not more than 140° C.

11. The method for producing an external toner additive according to claim 8, wherein the hydrophobicity of the inorganic fine particle is not more than 30 methanol vol %.

12. The method for producing an external toner additive according to claim 8, wherein the amount of the inorganic fine particle added in the step (i) is 20 mass parts to 80 mass parts per 100 mass parts of the crystalline resin.

13. The method for producing an external toner additive according to claim 8, wherein the inorganic fine particle is at least one selected from the group consisting of a silica fine particle, an alumina fine particle, a titania fine particle, a zinc oxide fine particle, a strontium titanate fine particle, a calcium carbonate fine particle and a cerium oxide fine particle.

14. The method for producing an external toner additive according to claim 8, wherein the acid value of the crystalline resin is from 5.0 mg KOH/g to 30.0 mg KOH/g.

15. The method for producing an external toner additive according to claim 8, wherein the crystalline resin contains a crystalline polyester.

16. The method for producing an external toner additive according to claim 8, wherein given Rx (nm) as the number-average particle diameter of a primary particle of the inorganic fine particle and Ry (nm) as the number-average particle diameter of a primary particle of the external toner additive, Ry/Rx satisfies the following Formula (5):

$$5.0\leq Ry/Rx\leq 100.0 \quad (5).$$

17. The method for producing an external toner additive according to claim 8, wherein the number-average particle diameter Rx of a primary particle of the inorganic fine particle is from 10.0 nm to 70.0 nm.

18. The method for producing an external toner additive according to claim 8, wherein the amount of the neutralizing agent added is from 0.5 mass parts to 15.0 mass parts per 100 mass parts of the crystalline resin.

19. The method for producing an external toner additive according to claim 8, wherein the amount of the surfactant added is not more than 1.0 mass part per 100 mass parts of the crystalline resin.

* * * * *